US006367649B1

(12) United States Patent
Balakumar

(10) Patent No.: US 6,367,649 B1
(45) Date of Patent: Apr. 9, 2002

(54) INFANT'S FEEDING CUP

(76) Inventor: Shanta Balakumar, 900 E. Diehl Rd., Suite 121, Naperville, IL (US) 60563

( * ) Notice: Subject to any disclaimer, the term of this patent is extended or adjusted under 35 U.S.C. 154(b) by 0 days.

(21) Appl. No.: 09/967,508

(22) Filed: Sep. 28, 2001

Related U.S. Application Data

(60) Provisional application No. 60/236,216, filed on Sep. 28, 2000.

(51) Int. Cl.[7] ..... B65D 25/04

(52) U.S. Cl. ..... 220/575; 220/501; 220/703; 220/556; 220/505

(58) Field of Search ..... 220/575, 501, 220/703, 556, 505

(56) References Cited

U.S. PATENT DOCUMENTS 2,843,287 A * 7/1958 Finley ..... 220/575
3,223,127 A * 12/1965 Sidebottom ..... 220/501
5,176,282 A * 1/1993 Rapaz ..... 220/575
5,405,030 A * 4/1995 Frazier ..... 220/575
5,878,908 A * 3/1999 Foley ..... 720/575

* cited by examiner

*Primary Examiner*—Joseph M. Moy
(74) *Attorney, Agent, or Firm*—Jerry A. Schulman

(57) ABSTRACT

A feeding cup for infants has a main reservoir communicating through a channel to a feeding spout. Breast milk placed in the reservoir enters the spout via the channel when the cup is tilted or when the sidewalls of the reservoir are compressed to create a pumping action. The reservoir is curved to fit a user's hand and has sidewalls that are thicker than the walls of the channel. The spout is designed to allow drop-by-drop dispensing of the breast milk.

14 Claims, 3 Drawing Sheets

INFANT'S FEEDING CUP

REFERENCE TO RELATED APPLICATION

This application claims priority from U.S. Provisional Patent Application Ser. No. 60/236,216, entitled "Infant's Feeding Cup" and filed Sep. 28, 2000.

BACKGROUND OF THE INVENTION

The present invention relates to feeding apparatus for children and, more particularly, to a feeding cup for infants who have difficulty breast feeding.

Breast milk is widely accepted as the most appropriate and nutritious food for infants. Under certain circumstances it is not practical to breast feed an infant, such as when the infant has difficulty sucking. It is possible to collect milk from the mother's breast, store it and feed it to the infant from a suitable feeding apparatus. Most commonly this is done by placing the collected breast milk in a common feeding expedient such as a formula bottle. Use of conventional baby formula feeding apparatus to dispense breast milk has its drawbacks. Breast milk is not of the same composition and consistency of formula as most formulas are water based and are fed to infants in a greater volume and at a higher flow rate than breast milk. Bottles designed for delivering formula to infants work well when formula is used, but do not work particularly well with breast milk. Infants may also become confused if fed from both bottle and breast because the bottle nipple differs from that of the mother. Under such circumstances the infant may refuse the mother's nipple entirely.

Other devices such as syringes; droppers, medicine cups or spoons have also been used but in general these devises are more difficult and tedious to maneuver and may also cause the infant to aspirate the collected breast milk.

An example of an apparatus designed specifically to feed breast milk to an infant is shown in U.S. Pat. No. 5,878,908 (Foley). Described as a "supplemental feeding cup" the Foley device has a main chamber used for collecting the breast milk and an auxiliary reservoir from which the infant is fed. A channel connects the main chamber and auxiliary reservoir allowing the Foley device to be tilted to direct milk from the main chamber to the reservoir and thereafter having the infant feed from the reservoir. Examples of apparatus constructed in accordance with the teachings of the Foley reference show that the cup is formed from a flexible thermoplastic material. The communicating channel in Foley extends from the bottom of the main chamber upward to the auxiliary reservoir. As seen in Foley, the auxiliary reservoir is somewhat rectangular and blunt in shape and delivers liquid in a substantially continuous flow when tilted from its relatively broad front lip, requiring the infant to use its tongue to "lap" the liquid.

Other examples of feeding apparatus for infants include U.S. Pat. No. 6,113,625 (Foley) which teaches and describes a drinking cup with teat attachment consisting of a customized nipple which may be attached to a wide variety of containers for formula or breast milk. The nipple includes a venting valve and an extension tube upon which the infant sucks to obtain breast milk from the container.

U.S. Pat. No. 4,801,027 (Hunter) teaches and describes a nipple feeder arrangement having a rigid lid to which a soft, flexible teat-like drinking spout is integrally attached.

While the foregoing references describe feeding apparatus suitable for certain feeding purposes, they do not offer the advantages offered by the present invention.

Feeding systems that require the filling of a rigid or semi-rigid container to which a feeding cap is attached, do not address the problem of collecting breast milk and supplying it contemporaneously to a baby.

Even cup constructions which are designed primarily for feeding breast milk are generally difficult to hold for extended lengths of time, making it more difficult to supply milk to an infant in a controlled manner and are not capable of any auxiliary pumping action to control the flow of milk to the reservoir nor to deliver it drop-by-drop to the infant. Consequently, there is a need for an improved infant feeding cup used for collecting and administering breast milk to an infant.

It is an object of the present invention to provide an infant's feeding cup which enables the user to collect breast milk and feed it to an infant exhibiting difficulty in normal breast feeding.

It is a further object of the present invention to provide such feeding cups configured to be easy to grip and control.

It is a further object of the present invention to provide such cups with flow control features to allow infants to ingest liquid food by lapping or drop-by-drop.

It is a further object of the present invention to provide such cups in forms to limit the opportunity for aspiration of liquid food by controlling the volume of such food available to an infant.

It is a further object of the present invention to provide such cups in forms which are easy and economical to manufacture and simple and convenient to use.

BRIEF SUMMARY OF THE INVENTION

The infant feeding cup of the present invention is formed as a unitary receptacle from a material which is soft, flexible, easily sanitized and manipulable to control the flow of breast milk held within. The receptacle is formed generally as a curvilinear vessel having an elongated "spoon-shaped" spout and a collection reservoir with the spout attached at a neck to the uppermost portion of the reservoir at one end thereof. A hollow supporting rib is attached at the neck to the underside of the spout and to the reservoir, and forms a conduit for the milk. At the end opposite the spout end a generally flat handle is integrally formed.

The receptacle has a flat base which forms the bottom of the collection chamber enabling the feeding cup to stand upright on a flat surface. This allows the cup to stand upright in a stable position when it is full, partially full or empty. The reservoir is formed in a generally irregular oval shape with the spout and handle aligned along the major axis of the oval.

The flexible material used to form the apparatus allows the user to control the flow of breast milk from the collection chamber to the spout by allowing a user to force milk along the neck by compressing the reservoir or to close off the neck completely to trap a supply of milk in the spout. The configuration of the spout also allows drop-by-drop feeding of the breast milk from the collection chamber through the spout to the mouth of the infant. In a second preferred embodiment a series of lateral ribs is formed at the end of the spout at right angles to the milk flow path to provide greater flow control and allow milk to drip from the spout.

The spout is designed to hold about 1.5 ml of milk, an amount which helps to avoid aspiration.

BRIEF DESCRIPTION OF THE DRAWINGS

These and further aspects of the present invention will become more apparent upon consideration of the following written description of the invention taking together with the drawings, wherein.

DETAILED DESCRIPTION OF THE DRAWINGS

Figure 1:
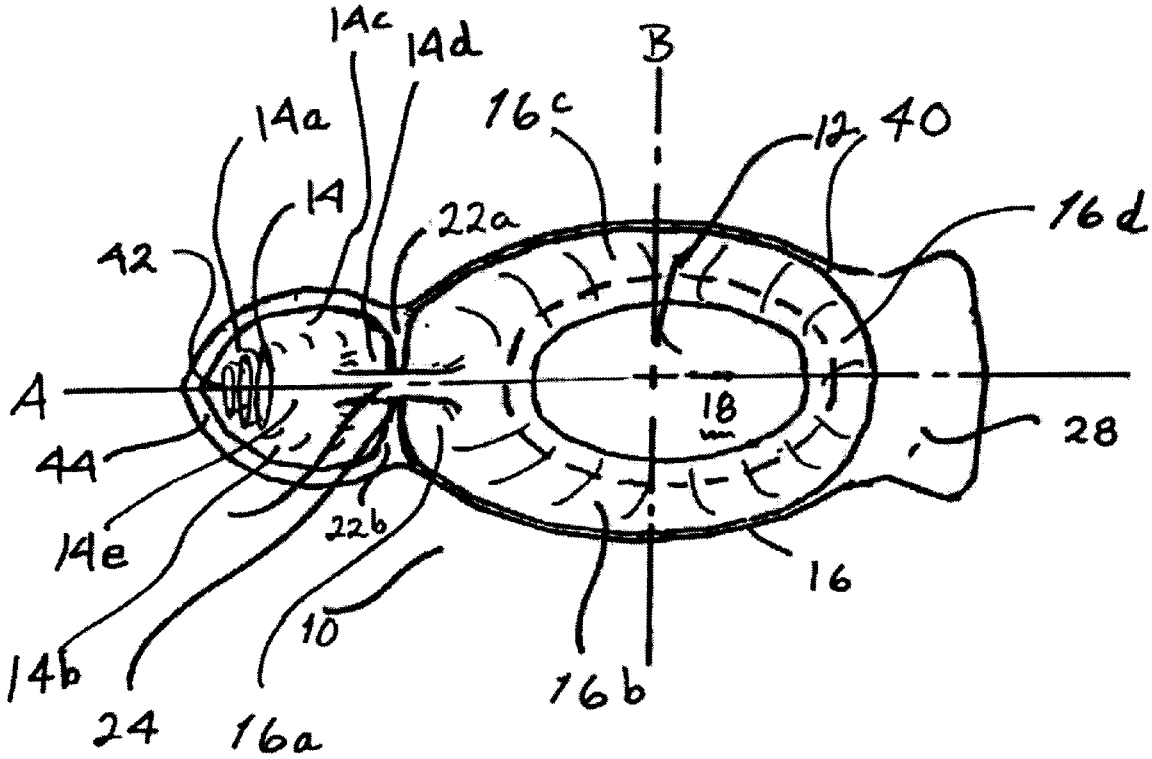
FIG. 1 is a top plan view of a preferred embodiment of the present invention.

Referring now to FIG. 1 the numeral 10 indicates generally an infant feeding cup constructed in accordance with the preferred embodiment of the invention described herein. Cup 10 is preferably formed of a soft, pliable, sterilizable thermoplastic material believed to be well known in the art, such as food grade polypropylene.

It should be noted throughout that the preferred embodiments described herein are formed as a single molded item with all parts forming a single integral unit.

As seen in FIG. 1, cup 10 has a well or reservoir 12 from which a spout 14 extends. Reservoir 12 is preferably somewhat pear-shaped, that is, formed in a somewhat elongated irregular oval or "pear" configuration.

Figure 4:
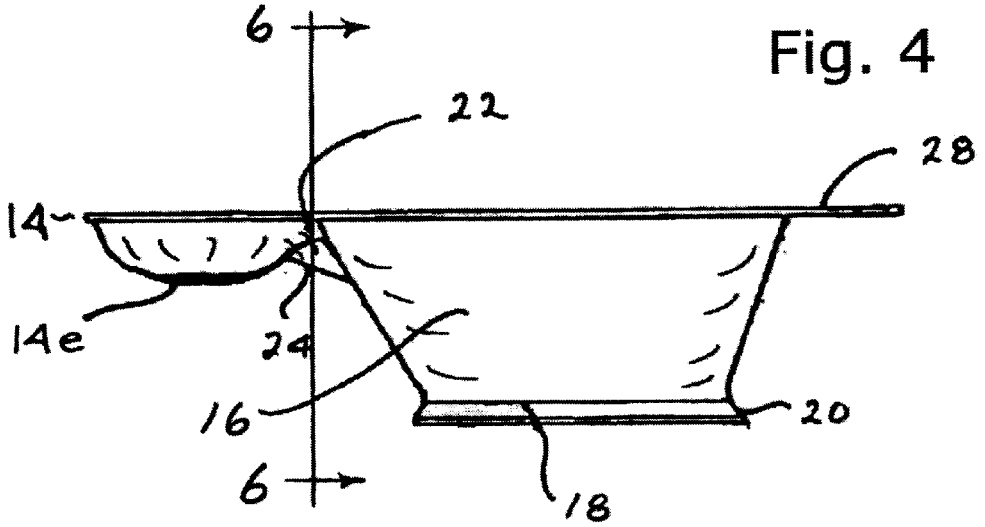
FIG. 4 is a lateral plan view of the embodiment shown in FIG. 1.
Figure 5:
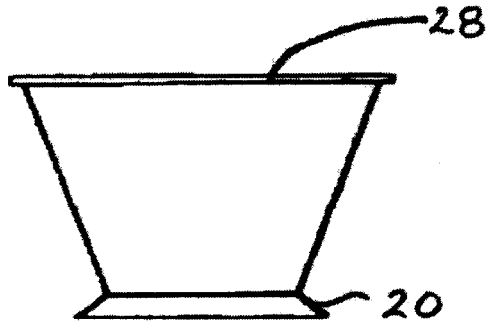
FIG. 5 is a rear plan view of the embodiment shown in FIG. 1.

Referring to FIGS. 1, 4 and 5, it can be seen that reservoir 12 is formed with a curvilinear, generally oval wall 16 joined to a flat bottom 18. Wall 16 has front, left side, right side and rear wall segments 16*a*, 16*b*, 16*c* and 16*d*, respectively.

Figure 2:
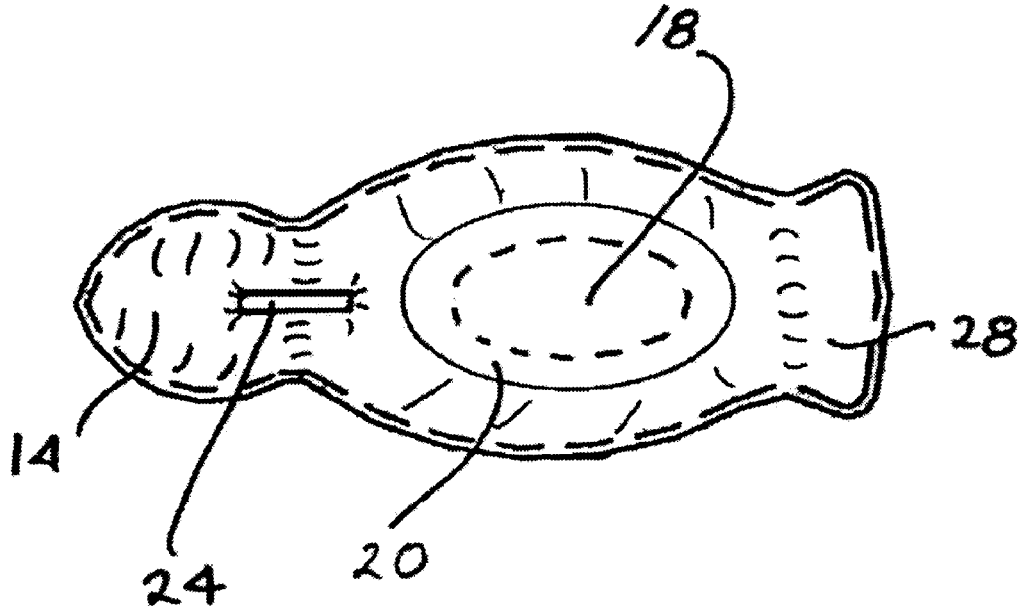
FIG. 2 is a bottom plan view of the embodiment shown in FIG. 1.

As seen in FIGS. 2 and 5, a base 20 is formed integrally with bottom 18, preferably as a flat oval projection upon which cup 10 can rest when it is placed on a flat surface.

Figure 7:
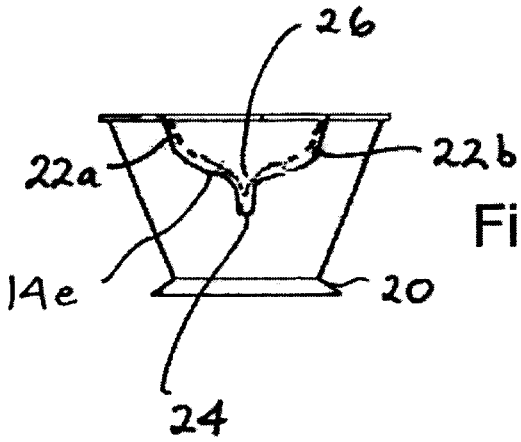
FIG. 7 is a front plan view of the embodiment shown in FIG. 1.

As seen in FIGS. 2 and 7, spout 14 has curvilinear front, left side, right side and rear wall segments 14*a*, 14*b*, 14*c* and 14*d*, respectively, and a curvilinear bottom 14*e*.

Figure 6:
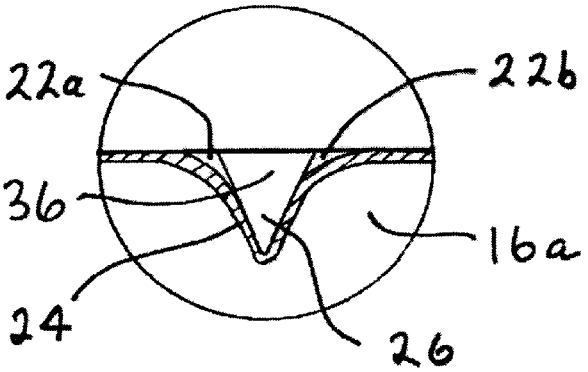
FIG. 6 is a partial sectional view of the neck taken along 6—6 of FIG. 5.

As seen in FIGS. 6 and 7 spout 14 is joined to reservoir 12 at a neck 22 and is preferably reinforced by a rib 24 extending from spout 14 to wall 16. Neck 22 and rib 24 may also be seen in FIG. 1 where neck segments 22*a* and 22*b* are shown joined to rib 24. As more clearly seen in FIGS. 1 and 6, neck segments 22*a* and 22*b* slope downwardly toward one another. In one preferred embodiment of the present invention, rib 24 is formed with a hollow channel 26 to facilitate flow of breast milk from reservoir 12 to spout 14.

Referring now to FIGS. 1, 2 and 4, a handle 28 extends from reservoir 12 positioned opposite spout 14. Cup 10 is preferably configured and dimensioned such that when a user's hand grasps reservoir 12 with a forefinger on one side and the thumb on the opposed side, handle 28 will rest upon that part of the hand on which the forefinger and thumb join to provide added stability when the cup is being held.

As best seen in FIG. 1 the oval shape of reservoir 12 has both a major axis A and a minor axis B and it is a preferred aspect of the present invention that spout 14, the longest dimension of reservoir 12 and handle 28 extend along major axis A.

Figure 3:
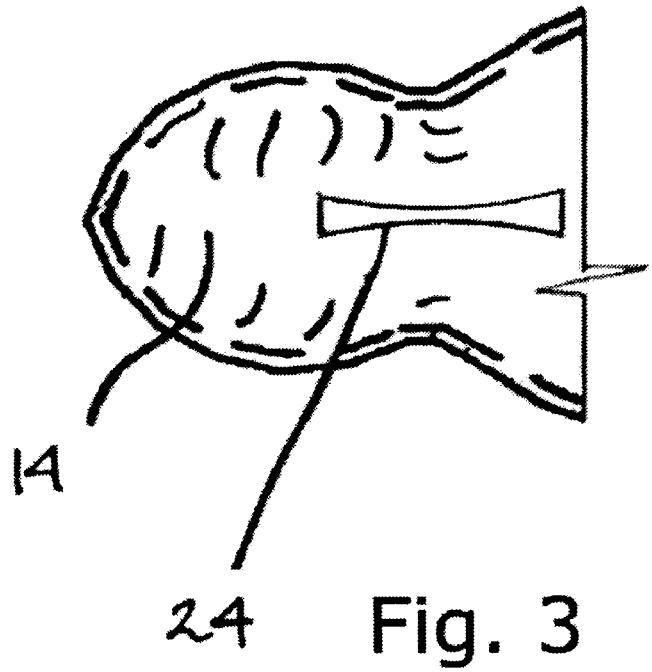
FIG. 3 is an enlarged view showing the neck of FIG. 2 pinched shut.

As exemplified by the shading in FIGS. 1, 2 and 3, another aspect of the preferred embodiment described herein is that the inner lateral surface of reservoir 12 and the inner lateral and bottom surface of spout 14 are curvilinear to facilitate the flow of milk from reservoir 12 to spout 14 along axis A in a controlled fashion to enable an infant to drink from cup 10.

The flexible nature of the material used to form cup 10 also assists in such flow by enabling the user to compress the sides of reservoir 12 affecting the flow of milk to spout 14. By compressing and releasing the reservoir wall milk is pumped from reservoir 12 to spout 14. Reservoir 12 can also be compressed sufficiently to pinch neck 22 shut, preventing milk in spout 14 from draining back into reservoir 12.

Referring now to FIG. 6 a partial sectional detail of the neck 22 and rib 24 are shown. As seen in section, neck segments 22*a* and 22*b* slope downward to form a generally V-shaped opening 36 in wall 16*a* of reservoir 16. Rib 24 is joined to wall 16*a* at opening 36 and rib channel 26 is itself V-shaped. Preferably, neck segments 22*a*, 22*b* and wall 38 of rib 24 are formed with a wall thickness slightly less than the remainder of cup 10. For example one preferred construction has the wall thicknesses of spout 14 and reservoir 16 as 0.030 inch while neck segments 22*a* and 22*b* and rib 24 have wall thicknesses of 0.027 inch. This construction is believed to make the lowermost portion of cup 10 more stable to grip while allowing the uppermost portion to be more easily compressed.

Yet another preferred embodiment enhances the ability of cup 10 to deliver milk in drop-by-drop fashion. As seen in FIG. 1, a series of raised ribs 42 are formed proximate the tip of spout 14, acting to control the flow of milk sufficiently to allow the milk to drip from spout 14 over a spout rim 44.

Use of the described preferred embodiment may now be described. Breast milk is collected in reservoir 12 from which it is dispensed through spout 14 by tilting cup 10 to induce flow of milk from reservoir 12 into spout 14 and by compressing reservoir 12 to pump milk through neck 22. Milk may be dispensed directly to the mouth of an infant for feeding or to a storage container if the breast milk is intended to be stored and used at a later date. As cup 10 is tilted with respect to the horizontal, milk flows from reservoir 12 to and through neck 22 over neck segments 22*a* and 22*b* and neck channel 26 formed in rib 24. Milk reaches the tip of spout 14 and is allowed to drip into the infant's mouth. Because of the soft construction of the cup it is less likely that use of the cup will cause discomfort to the infant during feeding.

The ease of construction of the cup 10 and the relatively inexpensive materials and simple molding facilities required will enable cup 10 to be very economically manufactured. Cup 10 may be sterilized by boiling or after being sealed in a clean plastic bag or container for later use and is of such a size that it can easily be carried in a purse or diaper bag.

Figure 8:
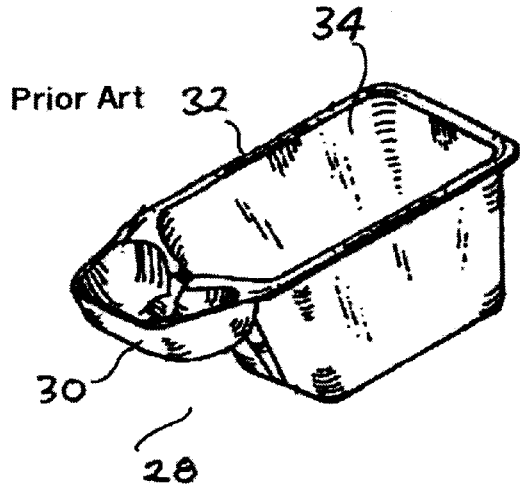
FIG. 8 is a perspective view of a prior art device.

Referring now to FIG. 8, numeral 28 indicates a prior art feeding cup as shown and described in U.S. Pat. No. 5,878,908 (Foley). As can be appreciated by viewing FIG. 8 and reading the '908 patent, it is rectangular in shape and requires the auxiliary reservoir 30 to be filled by tilting cup 32 sufficiently to draw milk from main receptacle member 34 at a relatively steep angle (See FIG. 1 of the '908 patent herein incorporated by reference). The present invention allows milk to be fed from the cup more efficiently due to the cup's ergonomically shaped reservoir and handle combination which allows the cup to rest comfortably in the user's hand, and by the spout construction which allows drop-by-drop dispensing.

While the foregoing describes a preferred embodiment or embodiments of the present invention, it is to be understood that this description is made by way of example only and is not intended to limit the scope of the present invention. It is expected that alterations and further modifications, as well as other and further applications of the principles of the present invention will occur to others skilled in the art to which the invention relates and, while differing from the foregoing, remain within the spirit and scope of the invention as herein go described and claimed. Where means-plus-function clauses are used in the claims such language is intended to cover the structures described herein as performing the recited functions and not only structural equivalents but equivalent structures as well. For the purposes of the present disclosure, two structures that perform the same function within an environment described above may be equivalent structures.

I claim:

1. A supplemental feeding cup for feeding liquid foods to infants, said feeding cup comprising:

a relatively large and generally elongated open-topped reservoir having a bottom panel integrally joined to a curvilinear reservoir wall, said reservoir wall having front, left side, right side and rear wall segments, said open reservoir top defined by an upper rim of said reservoir wall;

a relatively small open-topped feeding spout, said feeding spout comprising a generally spoon-shaped receptacle having a curvilinear bottom formed integrally with a curvilinear spout wall, said spout wall having front, left side, right side and rear wall segments, said open spout top defined by an upper rim of said spout wall, said spout rear wall segment integral with and extending from said reservoir front wall segment, said reservoir and said spout formed from a flexible thermoplastic material; and means for transferring said foods from said reservoir to said spout, said transfer means comprising a neck communicating with said reservoir front wall and said spout rear wall, said channel being selectively closed off by compressing said reservoir wall.

2. The apparatus as recited in claim 1 wherein said cup further comprises a hollow rib extending from said reservoir front wall segment to said spout rear wall segment at said neck.

3. The apparatus as recited in claim 2 wherein said channel is defined by said rib.

4. The apparatus as recited in claim 3 wherein said neck is positioned substantially proximate to said reservoir rim and substantially proximate to said spout bottom.

5. The apparatus as recited in claim 1 wherein said reservoir is generally pear-shaped in a cross-section taken parallel to said reservoir bottom.

6. The apparatus as recited in claim 5 wherein said reservoir rear wall is relatively larger than said reservoir front wall.

7. The apparatus as recited in claim 1 Wherein said elongated reservoir has a major axis and a minor axis, said major axis being longer in length than said minor axis.

8. The apparatus as recited in claim 7 wherein said reservoir further comprises a handle integral with said rear reservoir wall segment.

9. The apparatus as recited in claim 8 wherein said handle and said spout are aligned along said major axis.

10. The apparatus as recited in claim 2 wherein said rib comprise rib wall segments, said rib wall segments being relatively thinner than said reservoir wall segments.

11. The apparatus as recited in claim 10 wherein said reservoir wall segments are 0.030 inch thick and said rib wall segments are 0.027 inch thick.

12. The apparatus as recited in claim 1 wherein said spout further comprises means for dispensing said foods in a drop-by-drop manner.

13. The apparatus as recited in claim 12 wherein said dispensing means comprises at least one upraised rib formed on an interior surface of said front spout wall segment.

14. The apparatus as recited in claim 13 wherein each said rib is formed to extend in a direction perpendicular to the path of said food from said reservoir to said spout front wall segment.

* * * * *